US008635938B2

(12) United States Patent
King et al.

(10) Patent No.: US 8,635,938 B2
(45) Date of Patent: Jan. 28, 2014

(54) RETRACTABLE ROTARY TURRET

(75) Inventors: William B. King, Rancho Palos Verdes, CA (US); John D. Isker, Sun City, CA (US); Chaunchy F. Mckearn, Thousand Oaks, CA (US); Eric J. Griffin, Rancho Palos Verdes, CA (US)

(73) Assignee: Raytheon Company, Waltham, MA (US)

( * ) Notice: Subject to any disclaimer, the term of this patent is extended or adjusted under 35 U.S.C. 154(b) by 240 days.

(21) Appl. No.: 13/115,350

(22) Filed: May 25, 2011

(65) Prior Publication Data

US 2012/0297969 A1 Nov. 29, 2012

(51) Int. Cl.
*F41A 23/24* (2006.01)

(52) U.S. Cl.
USPC ..... 89/37.21; 89/1.11; 250/234; 244/130

(58) Field of Classification Search
USPC ..... 244/1 R, 129.1, 130, 129.4, 121; 89/37.21, 1.11, 41.01; 250/234, 203.1, 250/208.1, 236
See application file for complete search history.

(56) References Cited

U.S. PATENT DOCUMENTS

| | | | | |
|---|---|---|---|---|
| 2,392,106 | A | 1/1946 | Sutton | |
| 2,414,608 | A * | 1/1947 | Pontius, III | 89/37.17 |
| 4,108,045 | A | 8/1978 | Herbst | |
| 4,208,087 | A | 6/1980 | Cooper et al. | |
| 4,506,852 | A * | 3/1985 | Adams et al. | 244/173.3 |
| 4,593,288 | A * | 6/1986 | Fitzpatrick | 343/705 |
| 4,677,288 | A | 6/1987 | Smith | |
| 4,705,343 | A * | 11/1987 | Simons | 359/354 |
| 4,883,348 | A | 11/1989 | Spivey et al. | |
| 5,204,785 | A | 4/1993 | Tang et al. | |
| 5,775,643 | A | 7/1998 | McMaster et al. | |
| 5,806,789 | A * | 9/1998 | Boulware et al. | 244/1 R |
| 6,129,307 | A | 10/2000 | Deoms et al. | |
| 6,226,125 | B1 | 5/2001 | Levy et al. | |
| 6,405,975 | B1 * | 6/2002 | Sankrithi et al. | 244/1 R |
| 6,616,097 | B2 * | 9/2003 | Hilbert | 244/118.1 |
| 6,878,923 | B2 | 4/2005 | Casteleiro | |

(Continued)

FOREIGN PATENT DOCUMENTS

| | | | |
|---|---|---|---|
| EP | 1529688 | A1 * | 5/2005 |
| WO | 2009120847 | A1 | 10/2009 |

OTHER PUBLICATIONS

McHale, "The Airborne Laser: It's Huge, it flies, and it blows up missiles", Penn Well—Military and Aerospace Electronics (Aug. 1, 2004); http://www.militaryaerospace.com/articles/print/volume-15/issue-8/features/specialreport/the-airborne-laser-its-huge-it-flies-and-it-blows-up-missiles.html.

(Continued)

*Primary Examiner* — Benjamin P Lee
(74) *Attorney, Agent, or Firm* — Pierce Atwood LLP; Joseph M. Maraia

(57) ABSTRACT

The technology can include a retractable rotary turret system. The system includes a base comprising two support arms. The system further includes a turret platform that is a truncated sphere having a substantially flat side and a substantially spherical side. The turret platform includes a turret support ring rotary coupled to the two support arms and a turret device isolatively coupled to the turret support ring. The turret platform is rotatable along a first dimension for deployment of the spherical side and is rotatable along the first dimension for deployment of the flat side.

20 Claims, 8 Drawing Sheets

(56) References Cited

U.S. PATENT DOCUMENTS

| | | | | |
|---|---|---|---|---|
| 6,879,447 | B2 | 4/2005 | Casteleiro | |
| 6,894,818 | B1 | 5/2005 | Cicchiello et al. | |
| 6,969,176 | B2 | 11/2005 | Pohle | |
| 7,002,127 | B2 * | 2/2006 | Billman | 250/201.9 |
| 7,023,615 | B1 | 4/2006 | Voigt et al. | |
| 7,307,771 | B2 | 12/2007 | Foote | |
| 7,626,152 | B2 | 12/2009 | King et al. | |
| 7,642,741 | B2 | 1/2010 | Sidman | |
| 7,688,247 | B2 * | 3/2010 | Anschel et al. | 342/14 |
| 8,023,536 | B1 * | 9/2011 | Billman | 372/4 |
| 8,140,200 | B2 * | 3/2012 | Heppe et al. | 701/16 |
| 8,376,277 | B2 * | 2/2013 | Costanza et al. | 244/121 |
| 2004/0075884 | A1 | 4/2004 | Byren et al. | |
| 2005/0029394 | A1 * | 2/2005 | Ackleson et al. | 244/1 R |
| 2007/0152099 | A1 * | 7/2007 | Moreau | 244/117 R |
| 2007/0206177 | A1 * | 9/2007 | Anschel et al. | 356/28 |
| 2008/0105111 | A1 * | 5/2008 | Costanza et al. | 89/1.11 |
| 2009/0052478 | A1 * | 2/2009 | Vassberg et al. | 372/9 |
| 2009/0216394 | A1 * | 8/2009 | Heppe et al. | 701/16 |
| 2009/0218447 | A1 * | 9/2009 | von Flotow et al. | 244/131 |
| 2010/0073664 | A1 * | 3/2010 | Krasutsky | 356/4.01 |
| 2010/0078863 | A1 * | 4/2010 | Ullman et al. | 267/140.5 |
| 2010/0133388 | A1 * | 6/2010 | Demchenko et al. | 244/76 R |
| 2010/0176692 | A1 * | 7/2010 | Shmilovich et al. | 310/339 |
| 2011/0001020 | A1 * | 1/2011 | Forgac | 244/7 A |
| 2011/0075234 | A1 * | 3/2011 | Ullman | 359/221.2 |
| 2011/0084195 | A1 | 4/2011 | Schaub et al. | |
| 2012/0025021 | A1 * | 2/2012 | Jorgensen et al. | 244/129.4 |
| 2012/0104169 | A1 * | 5/2012 | von Flotow et al. | 244/131 |
| 2012/0297969 | A1 * | 11/2012 | King et al. | 89/41.01 |
| 2012/0298839 | A1 * | 11/2012 | King et al. | 250/203.1 |
| 2012/0318919 | A1 * | 12/2012 | Brown et al. | 244/120 |
| 2013/0048792 | A1 * | 2/2013 | Szarek et al. | 244/175 |

OTHER PUBLICATIONS

Lamberson et al., "The airborne laser", Proe. SHE 6346, XVI International Symposium on Gas Flow, Chemical Lasers, and High-Power Lasers, 63461M (Apr. 26, 2007); doi:10.1117112.738802; http://dx.dol.org/10.1117112.738802.

* cited by examiner

RETRACTABLE ROTARY TURRET

BACKGROUND

Beam delivery systems (e.g., sensor beam, laser beam, etc.) have generally been mounted in pods on the exterior of an aircraft, such as an unmanned aerial vehicle, a helicopter, or a fixed wing aircraft. Stowing mechanisms and features are generally used on the pod to protect the primary windows of the beam delivery system during take-off and landing of the aircraft. The pod itself generally remains outside the aircraft in the windstream. Typically, when the entire system must be protected, deployment mechanisms are used to move the turret from a storage bay of the aircraft into the windstream. With these mechanisms the storage bay volume is empty during system deployment, but the storage bay cannot be used for other components due to the need of the space during system retraction. In other configurations of the system, the predominant axis is roll, with azimuth and elevation gimbals nestled within the roll windscreen. In these configurations, the forward look angle is limited to the window length and, generally, cannot be extended to near forward look angles.

In other designs of the system, an on-axis telescope is utilized with an auto-alignment system to align the sensor system and/or beam delivery system with a target. The use of the on-axis telescope simplifies the auto-alignment system. However, a central obscuration created by a secondary mirror results in a matching hole in the output beam. The on-axis telescope configuration, generally, does not operate correctly for beam systems that produce a solid beam profile with no central obscuration. An off-axis, unobscured telescope for the beam delivery system overcomes this problem.

Thus, a need exists in the art for improved retractable rotary turret and/or rapidly deployable high energy laser beam delivery system.

SUMMARY

One approach provides a retractable rotary turret system. The system includes a base comprising two support arms. The system further includes a turret platform that is a truncated sphere having a substantially flat side and a substantially spherical side. The system further includes a turret support ring rotary coupled to the two support arms. The system further includes a turret device isolatively coupled to the turret support ring. The turret platform is rotatable along a first dimension for deployment of the spherical side and is rotatable along the first dimension for deployment of the flat side.

Another approach provides a truncated sphere turret platform. The turret platform includes a turret support ring rotary rotatable along an elevation axis. The turret platform further includes a turret device isolatively coupled to the turret support ring. The turret platform has a flat side and a spherical side. The turret platform is rotatable along the elevation axis for deployment of the spherical side and is rotatable along the elevation axis for deployment of the flat side.

Another approach provides a turret payload system. The system includes a payload support ring rotary coupled to two support arms. The system further includes a payload device isolatively coupled to the payload support ring. The system further includes a payload windscreen shell in a shape of a truncated sphere having a substantially flat side and a substantially spherical side on opposite sides of each other. The turret payload system is rotatable along the elevation axis over a first dimension for deployment of the spherical side and is rotatable over a second dimension for deployment of the flat side.

Another approach provides a high power laser beam delivery system. The system includes a rotary turret platform rotatable along multiple axes for aiming of a high power laser beam. The system further includes a turret payload device coupled to the rotary turret platform that is a truncated sphere and configured to rapidly deploy from a vehicle and stow within the vehicle. The system further includes at least two conformal windows in a spherical side of the turret payload device. The system further includes an off-axis telescope coupled to the turret payload device, having an articulated secondary mirror for correcting optical aberrations, and configured to reflect the high power laser beam to a target through the first of the at least two conformal windows. The system further includes an illuminator beam device coupled to the turret payload device and configured to detect atmospheric disturbance between the system and the target by actively illuminating the target to generate a return aberrated wavefront through the first of the at least two conformal windows. The system further includes a coarse tracker coupled to the turret payload device, positioned parallel to and on an axis of revolution of the off-axis telescope, and configured to detect, acquire, and track the target through the second of the at least two conformal windows.

Another approach provides a rotary turret system. The system includes a base comprising two support arms; a first rotating mechanism within the base configured to rotate the base perpendicular to a nominal direction of flight of a vehicle; a Coudé path configured to provide a path for a high energy laser beam from the base via the first support arm to a target; a second rotating mechanism in at least one of the two support arms and configured to rotate the base perpendicular to an azimuth axis of the base; and one or more fast steering mirrors configured to maintain proper beam location and orientation of the high energy laser beam through the Coudé path to the target.

In other examples, any of the approaches above can include one or more of the following features.

In some examples, the turret device includes a mirror drive assembly having a primary window in the spherical side of the turret platform and a coarse tracker assembly having a secondary window in the spherical side of the turret platform.

In other examples, a center axis of the primary window is off-set and parallel to a center axis of the secondary window.

In some examples, a center axis of the mirror drive assembly is off-set and parallel to a center axis of the turret platform.

In other examples, the primary window and the secondary window are curved to conform to an outer surface of the spherical side.

In some examples, the primary window and the secondary window are substantially flat.

In other examples, the system further includes a first mirror mounted within the base and for receiving optical energy from an optical energy system; a second mirror mounted within a top portion of the first support arm for receiving the optical energy from the first mirror and for directing the optical energy along an axis parallel to the first support arm; a third mirror mounted within a bottom portion of the first support arm for receiving the optical energy from the second mirror and for directing the optical energy through an opening in the turret platform; a fourth mirror mounted within the turret platform for receiving the optical energy from the third mirror and directing the optical energy to the turret device; a secondary mirror mounted within the turret device for receiving the optical energy from the fourth mirror and for expanding the optical beam path from the fourth mirror; and a primary mirror mounted with the turret device for receiving the optical energy from the secondary mirror and recollimating or focusing the optical energy based on a beam application.

In some examples, the beam application is a sensing application and the telescope collimates the optical energy based on a target range.

In other examples, the beam application is a high energy weapon application and the primary mirror focuses the optical energy onto a target.

In some examples, the turret device includes a high energy laser pointing and tracking system, wherein the high energy laser pointing and tracking system is usable during deployment of the spherical side of the turret platform.

In other examples, the turret device includes a passive optical sensor for providing imagery in one or more spectral bands in visible and infrared regions.

In some examples, the turret device includes a semi-active sensor for providing range finding or illuminated target tracking.

In other examples, the turret platform is rotatable along two axes, the first axis for deployment and aiming of the turret device, and the second axis for aiming of the turret device.

In some examples, the turret platform geometry is defined as $a^2=b(2R-b)$, wherein a is ½ of a maximum span of a circular footprint of the stowed side of the turret platform flush with an external surface of a vehicle; b is a maximum height of the spherical side when deployed from the vehicle; and R is a radius of the turret platform.

In other examples, the turret device includes an off-axis telescope with a spherical mirror, a figure mirror, a conic mirror, an on-axis telescope with central obscuration, and/or a refractive telescope.

In some examples, the turret platform includes a plurality of apertures in the deployed side of the turret platform.

In other examples, the turret device includes a mirror drive assembly having a primary window in the spherical side of the turret platform; and a coarse tracker assembly having a secondary window in the spherical side of the turret platform. The primary window and the secondary window are mounted side-by-side in the spherical side of the turret platform.

In some examples, the substantially flat side of the payload windscreen shell substantially conforms to a vehicle surface when stowed.

In other examples, the substantially spherical side of the payload windscreen shell provides a minimum protrusion outside a vehicle and maintains a maximum field of regard when deployed.

In some examples, the spherical side is substantially spherical.

In other examples, the at least two conformal windows are substantially spherical, and/or substantially flat.

In some examples, when stowed, the turret payload device conforms to an outer surface of the vehicle for maintaining at least one low observability characteristic of the vehicle.

In other examples, the system further includes an auto-alignment system configured to communicate commands to the articulated secondary mirror configured to modify aiming of the high power laser beam and to one or more fast steering mirrors configured to modify the aiming of the high power laser beam.

In some examples, the system further includes a wavefront error sensor coupled to the turret payload device and configured to determine an induced distortion of the aberrated wavefront of the returning illuminator beam from the target based on a beam quality metric for the target.

In other examples, the wavefront error sensor is further configured to communicate commands to the articulated secondary mirror based on the determined induced distortion to reduce large, low order wavefront aberrations.

In some examples, the wavefront error sensor is further configured to communicate commands to the articulated secondary mirror based on the determined induced distortion to reduce residual tilts of the high power laser beam.

In other examples, the system further includes an inertial measurement unit configured to detect errors from one or more commands communicated to the turret payload device based on an actual turret position and one or more fast steering mirrors coupled to the turret payload device and configured to modify aiming of the high power laser beam based on the detected errors.

In some examples, the turret payload device further includes a payload support ring rotary coupled to two support arms; a payload device isolatively coupled to the payload support ring; and a payload windscreen shell in a shape of a truncated sphere having a flat side and a spherical side on opposite sides of each other. The turret payload system is rotatable along the elevation axis over a first dimension for deployment of the spherical side and is rotatable over a second dimension for deployment of the flat side.

The techniques described herein can provide one or more of the following advantages. An advantage of the technology is that the turret system or parts thereof are rotatable along a single dimension for deployment of the spherical side and the flat side of the turret system, thereby eliminating the need to translate the azimuth base of the turret system. Another advantage of the technology is that the deployment time of the turret system for the single dimension rotation for deployment is reduced to that of the axis rotation speed, thereby decreasing the deployment time. Another advantage of the technology is that the single dimension deployment of the turret system advantageously reduces the dead space in the deployment vehicle (e.g., aircraft cargo bay), thereby maximizing the volume available for other components. Another advantage of the technology is the use of conformal apertures (i.e., windows in the turret system) for the spherical side of the turret system advantageously provides a consistent spherical shape in the airflow around the deployment vehicle, thereby maximizing the correction of aero-optic wavefront error (WFE) distortions and torque disturbances on the outer parts of the turret system.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

A retractable rotary turret and/or rapidly deployable high energy laser beam delivery system includes technology that, generally, provides a rapidly deployable turret system (e.g., a truncated sphere, a rounded protrusion, a rotating platform, etc.) that can be used with a deployment vehicle (e.g., low observability aircraft, aircraft, tank, helicopter, etc.) for delivery of a beam. The technology for rapid deployment of the mechanisms can be utilized to deliver the beam (e.g., laser beam, light beam, sensor beam, etc.) to a target. The technology enables sensitive components of the beam delivery system (e.g., sensor, telescope, window, etc.) to be protected during selected movements by the deployment vehicle (e.g., take-off and/or landing of an aircraft, movement of a tank through a forest, etc.) and rapidly deployed for beam delivery (e.g., two second deployment, etc.).

The technology can provide for deployment via a rotary motion of the turret system. The technology eliminates a design problem associated with the elevator mechanism of a turret system by replacing the vertical translation of an elevator with the simple motion of a turret ball rotating on its elevation axis to go from the stowed position to the deployed position, thereby advantageously increasing the efficiency of the deployment mechanism. The simple motion of the turret ball rotating on its elevation axis advantageously reduces the risk of damage caused to accidental deployment or stowing of the turret ball. In other words, the technology deploys and stows the turret system by rotating the turret system in a single dimension, thereby advantageously decreasing the time required for deployment (e.g., less than one second, less than five seconds, etc.) and reducing the forces exerted on the deployment vehicle. The deployment and stowing of the technology via the single dimension advantageously enables the technology is secured to the same base whether deployed or stowed, thereby increasing the rigidly of the technology.

The technology can provide a minimal protrusion of the deployed turret system from the vehicle while maintaining a maximum field of regard when deployed. When deployed, a small part of the spherical turret system is exposed to the air stream around the deployment vehicle, thereby advantageously reducing the tendency for wind buffeting to affect the optical line of sight (LOS) of the beam. When stowed, the turret system is flush with the outside contour of the deployment vehicle, thereby eliminating the necessity of a separate door or cover. The arrangement of the stowed side can enable the deployment vehicle to maintain various vehicle characteristics (e.g., low-profile, stealth, etc.). Another advantage of the one dimension deployment and stowing is that the beam can be kept in fully operational mode when stowed without risk of inadvertently hitting a deployment cover.

Figure 1:
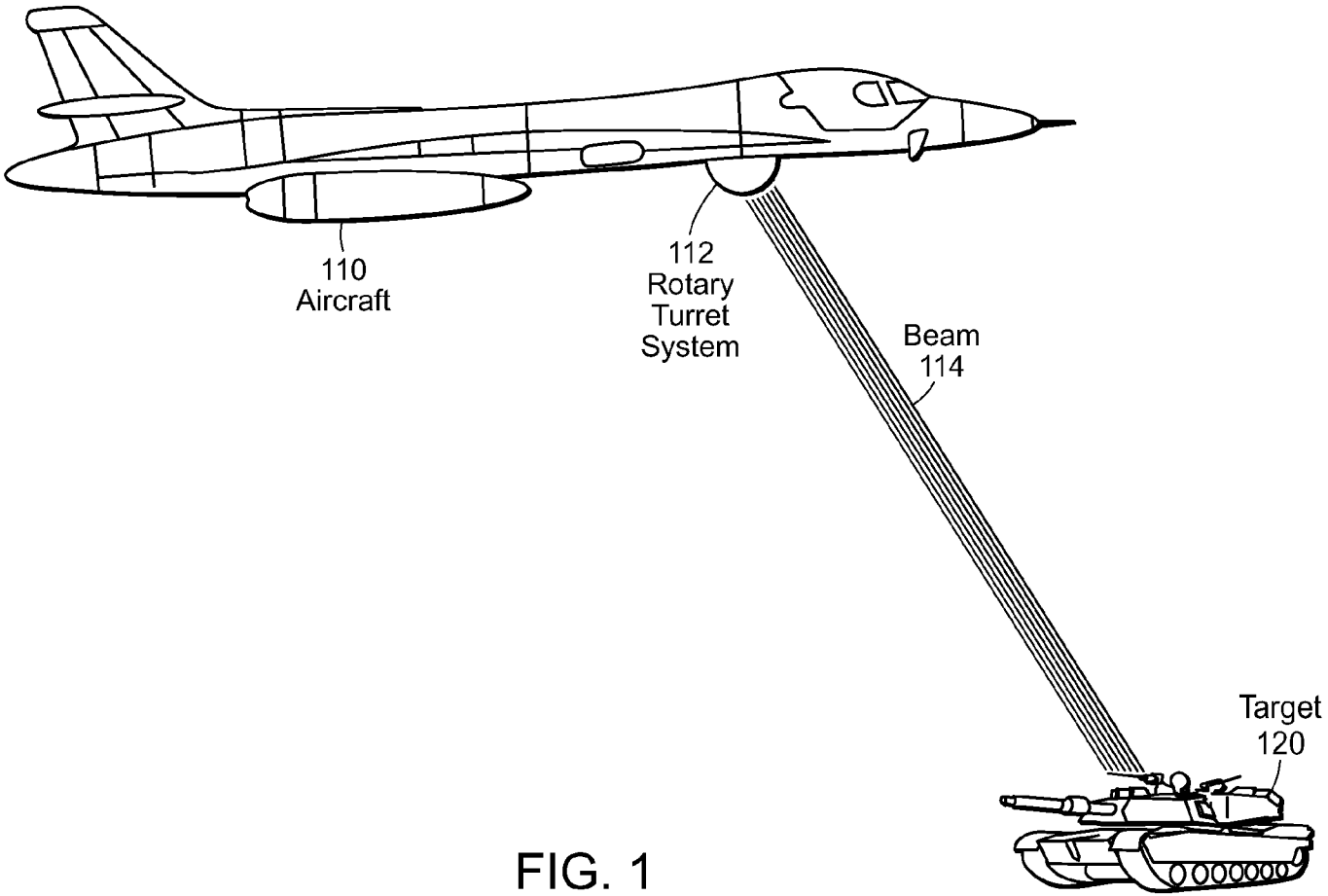
FIG. 1 is a diagram of an exemplary beam deployment environment.

FIG. 1 is a diagram of an exemplary beam deployment environment 100. The environment 100 illustrates an aircraft 110 with a rotary turret system 112 and a target 120 (in this example, a tank 120). The rotary turret system 112 directs a beam 114 onto the target 120. The beam 114 can be, for example, utilized by a sensor and/or laser beam system within the aircraft 110 to track the target 120 and/or damage/destroy the target 120.

Figure 2A:
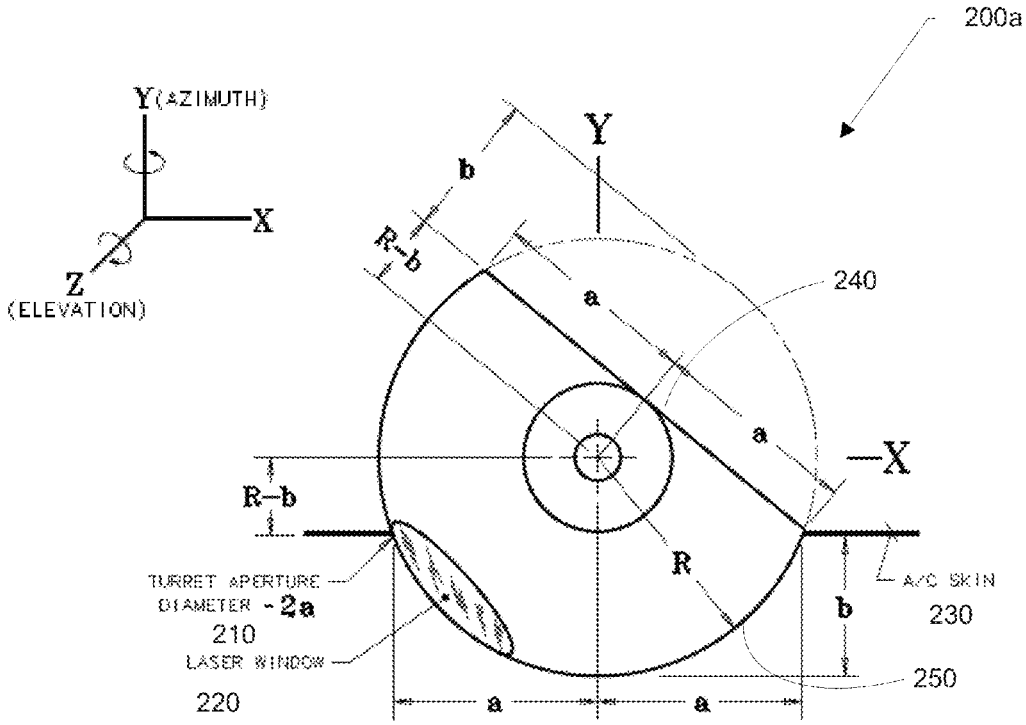
FIG. 2A is a diagram of an exemplary deployed payload device.

FIG. 2A is a diagram of an exemplary deployed payload device 200*a*. The payload device 200*a* is deployed from a deployment vehicle (not shown). The deployment vehicle can, for example, include an aircraft (e.g., helicopter, fixed wing aircraft, etc.), a tank, a train, an automobile, and/or any other type of transportation device. As illustrated in FIG. 2A, the payload device 200*a* is deployed from the deployment vehicle through the vehicle's skin 230 (in this example, the aircraft skin 230). The aperture diameter in the vehicle's skin is 2*a* (210), which is the length of a substantially flat side 240 of the payload device 200*a*. The payload device 200*a* includes a primary window 220 (in this example, a laser window 220). The payload device 200*a* and the primary window 220 can be utilized to direct various types of beams (e.g., high energy laser beam, sensor beam, infrared sensor beam, etc.) to a target.

As illustrated in FIG. 2A, the payload device 200*a* is a truncated sphere having a substantially flat side 240 (e.g., 100% flat, sloped at 1 degree angle, etc.) and a substantially spherical side 250 (e.g., 100% round, 98% round, etc.). The payload device 200*a* advantageously provides a large field of regard with a minimum exposed turret surface, thereby maximizing the active operating region while minimizing airflow turbulence. The payload device 200*a* advantageously provides a single rotation axis for deployment and stowing, thereby removing turret translation (i.e., vertical movement) and providing a built-in door (i.e., the flat side 240 of the payload device 200*a*) that conforms to the outer skin of the deployment vehicle.

In some examples, the primary window 220 and a secondary window (not shown) are conformal windows (e.g., substantially spherical, substantial flat, combination of spherical and flat, etc.) within the payload device 200*a* to maintain the spherical shape of the exposed turret, thereby reducing the frontal cross-sectional area and the associated aero-optic issues resulting from airflow turbulence. The reduction of the airflow turbulence advantageously reduces jitter, increases pointing accuracy, and/or minimizes the impact of the aerodynamics on the deployment vehicle.

The truncated sphere has a radius R with a portion of the sphere cut off (also referred to as the flat side 240). A circular section is through the center of the ball and the horizontal x-axis of the section parallel to the longitudinal axis of the deployment vehicle. The circular section is in the x-y plane of the sphere, with the out-of-plane z-axis defining the elevation axis and the y-axis as the azimuth axis; the pivot point is the center of the sphere, at the origin of the three axes. Referring to this circular section, the dashed arc segment is cut off; the length of the chord (also referred to as the flat side 240) is defined as 2*a*. The distance from the radius R to the chord of the truncated sphere is b. The distance from the center of the sphere to the chord is (R−b). The relationship between a, b, and R is in accordance with: $a^2=b(2R-b)$; wherein a=½ of a maximum span of a circular footprint of the stowed side of the turret platform with an external surface of the vehicle; b is a maximum height of the spherical side when deployed from the vehicle; and R is the radius of the turret platform. The distance from the pivot point to the bottom cutout is (R−b).

Figure 2B:
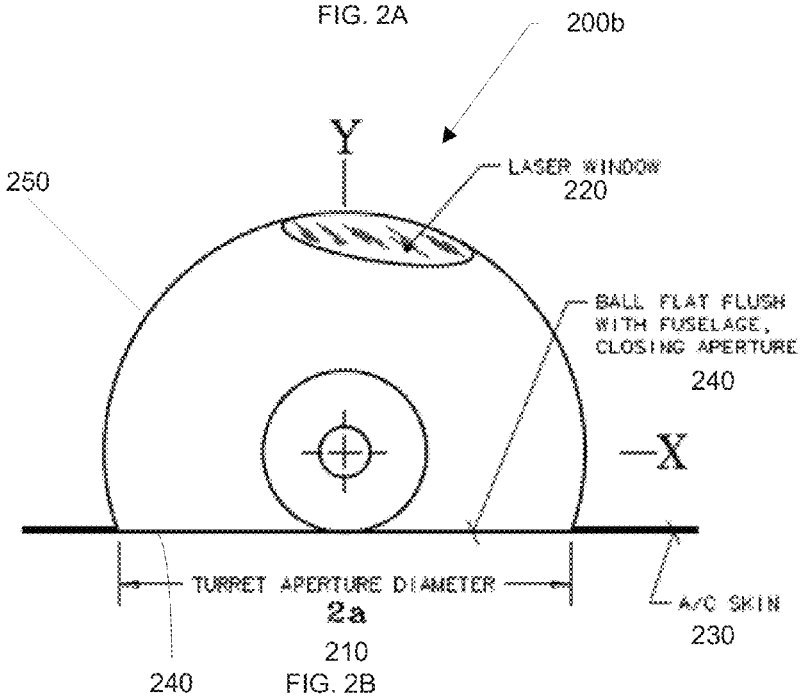
FIG. 2B is a diagram of an exemplary stowed payload device.

FIG. 2B is a diagram of an exemplary stowed payload device 200*b*. The stowed payload device 200*b* includes the same components as described above with respect to FIG. 2A. As illustrated in FIG. 2B, the payload device 200*b* is in a stowed position. In other words, the spherical side 250 is protected within the body of the deployment vehicle (e.g., aircraft cargo bay, car body, etc.) and the flat side 240 conforms to the skin 230 of the deployment vehicle. In some examples, the flat side 240 conforms to the skin 230 of the deployment vehicle to maintain at least one low observability characteristic of the deployment vehicle (e.g., stealth, low profile, etc.). The stowage of the payload device 200*b* within the body of the deployment vehicle and/or exposure of the flat side 240 to the environment advantageously protects the payload device 200*b* from damage.

Figure 3A:
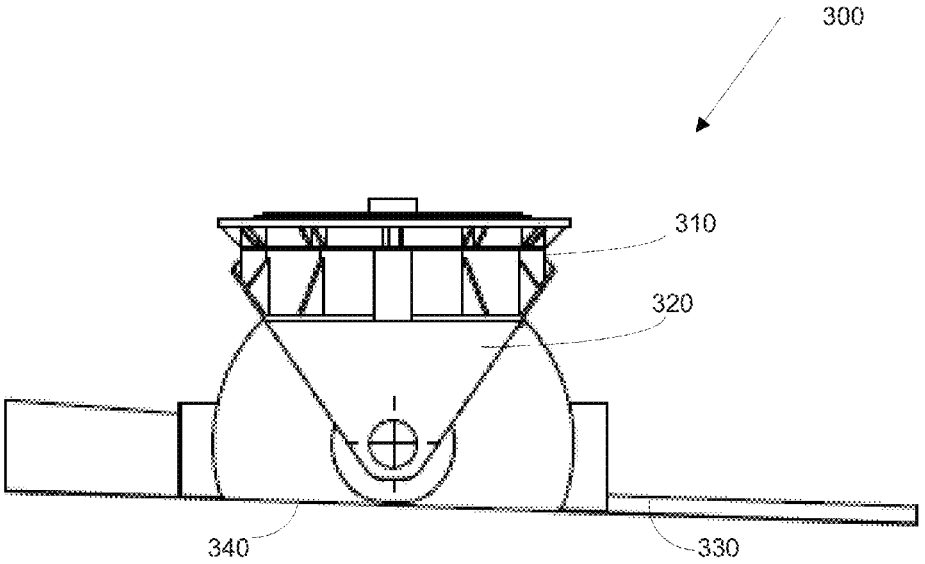
FIG. 3A is a side view of a diagram of an exemplary stowed turret system.
Figure 3B:
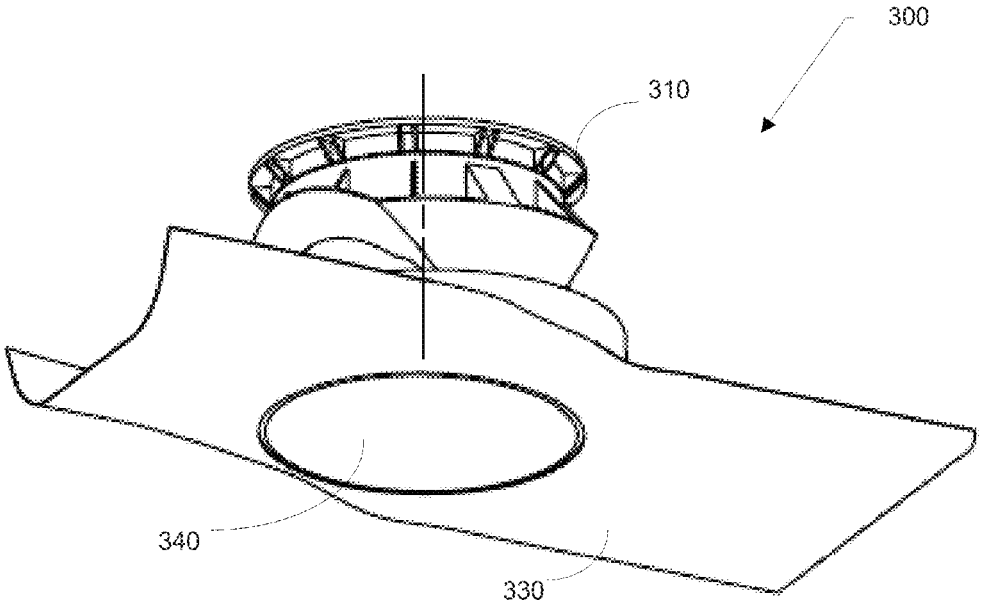
FIG. 3B is a perspective diagram of the stowed turret system of FIG. 3A.

FIG. 3A is a side view of a diagram of an exemplary stowed turret system 300. FIG. 3B is a perspective view of the turret system 300 of FIG. 3A. The turret system 300 includes a base 310 and two supporting arms 320 (second supporting arm is not shown). A flat side 340 of the turret system 300 conforms to an outer surface 330 of a deployment vehicle (not shown). The conformance to the outer surface 330 of the deployment vehicle advantageously enables the turret system 300 to maintain characteristics of the deployment vehicle while simplifying the deployment mechanism.

Figure 4A:
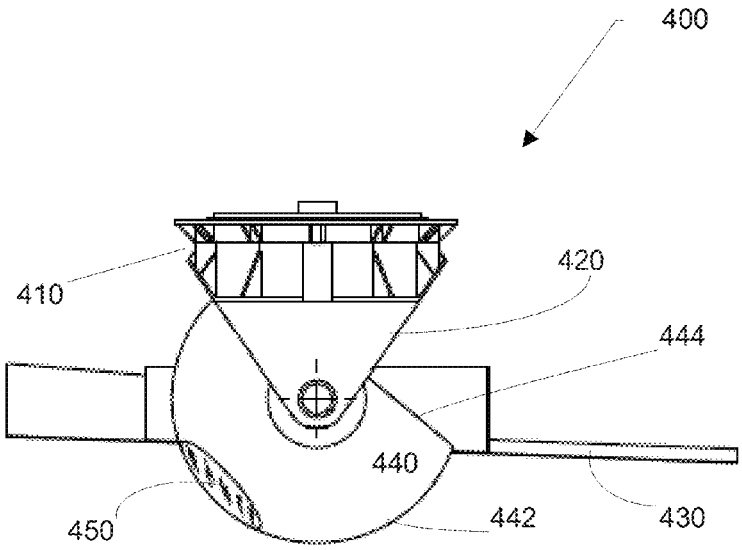
FIG. 4A is a side view of a diagram of an exemplary deployed turret system.
Figure 4B:
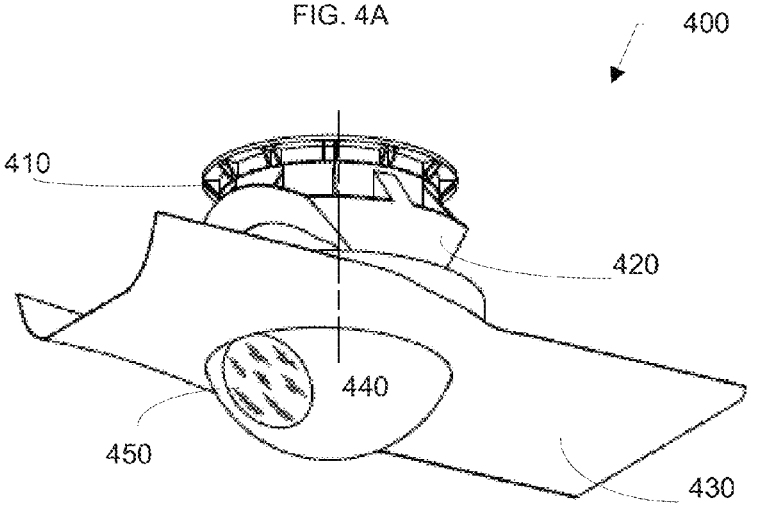
FIG. 4B is a perspective diagram of the deployed turret system of FIG. 4A.
Figure 4C:
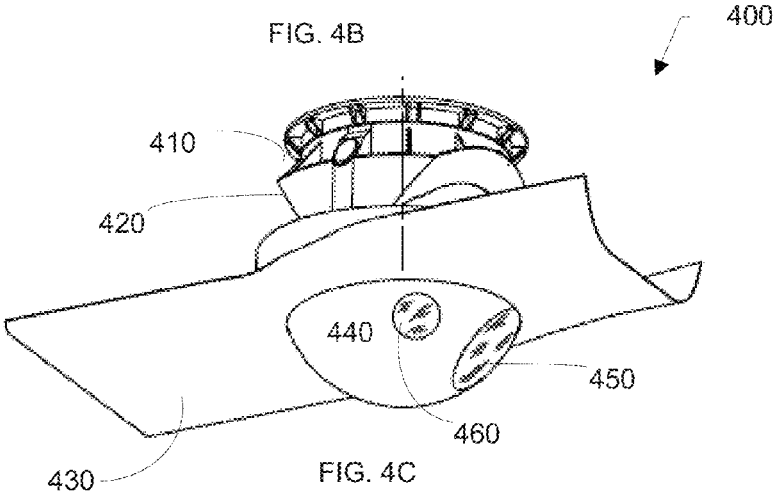
FIG. 4C is another perspective diagram of the deployed turret system of FIG. 4A.

FIG. 4A is a side view of a diagram of an exemplary deployed turret system 400. FIG. 4B is a diagram of another view of the turret system 400 of FIG. 4A. FIG. 4C is a diagram of another perspective view of the turret system 400 of FIG. 4A. The turret system 400 includes a base 410, two supporting arms 420, and a turret platform 440. The turret platform 440 is a truncated sphere with a substantially flat side 444 and a substantially spherical side 442. As illustrated in FIG. 4A, the spherical side 442 of the turret platform 440 extends from an outer surface 430 of a deployment vehicle (not shown). The spherical side 442 of the turret platform 440 includes a primary window 450 and a secondary window 460. The primary window 450 can be utilized by a beam delivery assembly and the secondary window 460 can be utilized by a coarse tracker assembly. The beam delivery assembly and the coarse tracker assembly can, for example, be utilized to direct (e.g., recollimate, focus, etc.) optical energy (e.g., laser beam, sensor beam, etc.) based on a beam application.

In some examples, a center axis of the primary window 450 is off-set and parallel to a center axis of the secondary window 460. The off-set and parallel configuration (e.g., side-by-side mounting) of the primary window 450 and the secondary window 460 enables the beam and the tracking beam to converge on a target and maximize lookdown angle for the deployed turret system 400. The off-set and parallel configuration of the primary window 450 and the secondary window 460 can minimize the minimum ball diameter advantageously, thereby enabling the technology to be packaged in small tactical flight volumes. In other examples, a center axis of the mirror drive assembly is off-set and parallel to a center axis of the turret platform 440. The off-set and parallel configuration (e.g., side-by-side mounting) of the primary window 450 and the secondary window 460 enables the beam and the tracking beam to converge on a target and maximize lookdown angle for the deployed turret system 400 and be compatible with an off-axis auto-alignment system.

In some examples, the primary window 450 and/or the secondary window 460 are curved to conform to the outer surface of the spherical side 442 of the turret platform 440. The curvature of the primary window 450 and the secondary window 460 can enable the turret system 400 to advantageously reduce air turbulence and minimize turret vibration. In other examples, the primary window 450 and/or the secondary window 460 are substantially spherical (e.g., 99% spherical, 97% spherical, etc.), substantially flat (e.g., wedged at 1%, concave, etc.), and/or substantially aspherical. The flat parts of the primary window 450 and the secondary window 460 can reduce the deflections of the beams, thereby decreasing the complexity of the alignment and beam mechanisms.

The beam application can be usable during deployment of the spherical side of the turret system 400. In some examples, the beam application is active during stowing of the spherical side of the turret system 400 and is rapidly deployable for use (e.g., range finding, target tracking, etc.). In other examples, the beam application is a sensing application, a high energy weapon application, a high energy laser pointing and tracking system, a passive optical sensor, a semi-active sensor, and/or any other type of beam application.

Figure 5A:
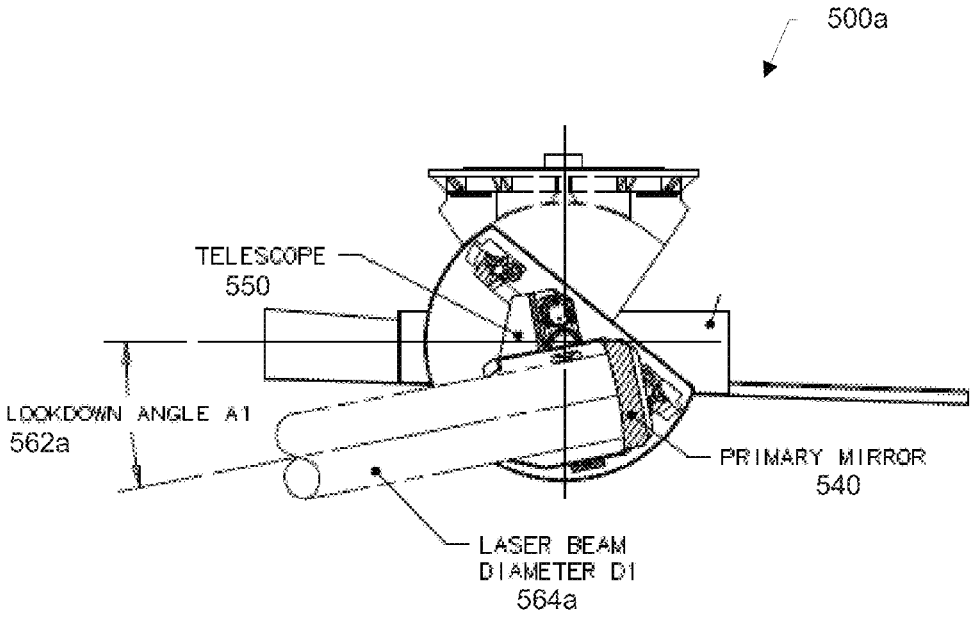
FIG. 5A is a sectional diagram of another exemplary deployed turret system.

FIG. 5A is a sectional diagram of another exemplary deployed turret system 500*a*. The turret system 500*a* includes a primary mirror 540 and a telescope 550. The telescope 550 is isolatively mounted to the turret system 500 in such a manner as to minimize the effects of mechanical and/or structural deflection of the turret system 500 that can adversely affect the LOS of the telescope 550. The primary mirror 540 is mounted to the telescope 550 and recollimates or focuses optical energy based on the beam application. As illustrated in FIG. 5A, the turret system 500*a* has a laser beam diameter D1 564*a* and a lookdown angle A1 562*a*. The lookdown angle A1 562*a* is the smallest lookdown angle A1 562*a* for the output beam diameter D1 564*a*.

Figure 5B:
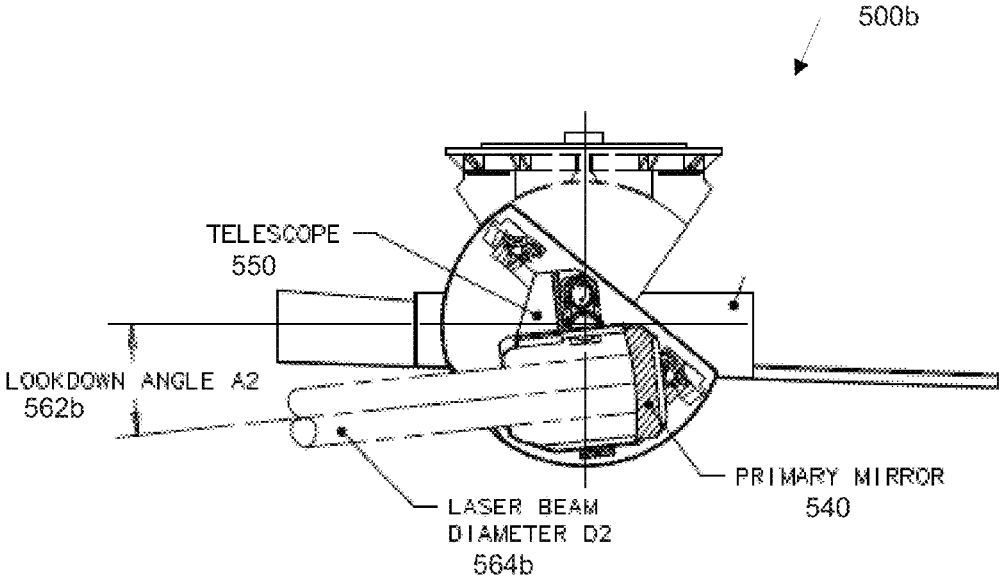
FIG. 5B is a sectional diagram of another exemplary deployed turret system.

FIG. 5B is a sectional diagram of another exemplary deployed turret system 500*b*. As illustrated in FIG. 5B, the turret system 500*b* has a laser beam diameter D2 564*b* and a lookdown angle B1 562*b*. The lookdown angle B1 562*b* is the smallest lookdown angle B1 562*b* for the output beam diameter D2 564*b*. As illustrated in FIGS. 5A and 5B, the lookdown angle A1 562*a* to A2 562*b* is reduced by reducing the laser beam diameter D1 564*a* to D2 564*b*.

Figure 6A:
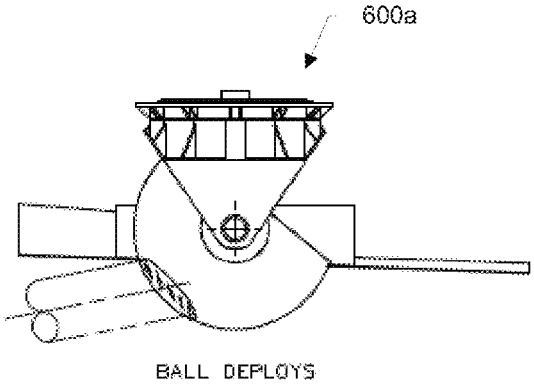
FIGS. 6A-6D are diagrams of exemplary deployed turret systems.
Figure 6B:
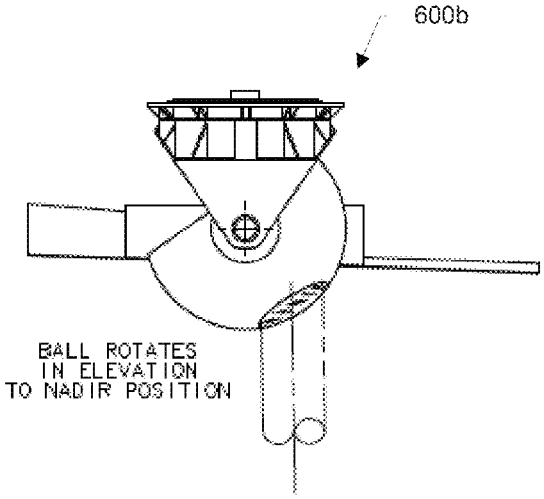
Figure 6C:
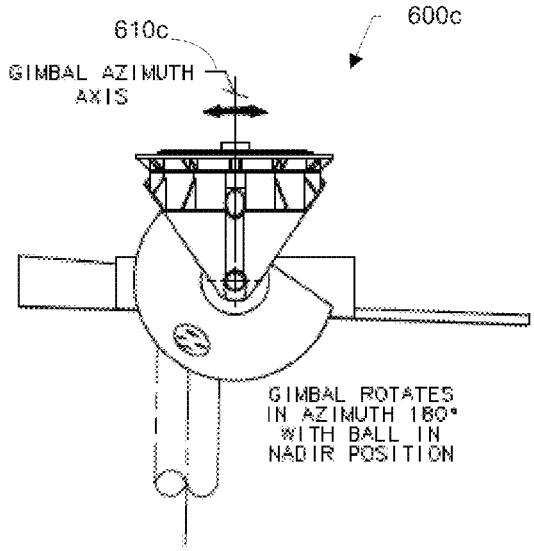
Figure 6D:
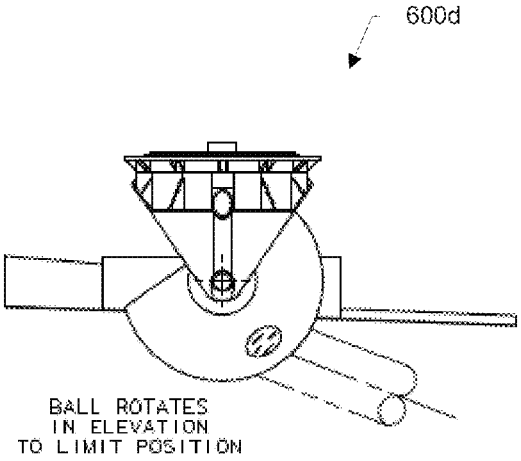

FIGS. 6A-6D are diagrams of exemplary deployed turret systems 600*a*, 600*b*, 600*c*, and 600*d* (generally referred to as turret system 600). FIG. 6A illustrates deployment of a turret platform of the turret system 600*a*. FIG. 6B illustrates deployment of the turret platform of the turret system 600*b* in a nadir position. FIG. 6C illustrates 180° rotation along an azimuth axis of the turret platform of the turret system 600*c* from the position illustrated in FIG. 6B while remaining in the nadir position. FIG. 6D illustrates deployment of the turret platform of the turret system 600*d* in an elevated position to a stop-limit (e.g., the minimum lookdown angle for the turret system 600*d* configuration).

FIGS. 6A-6D illustrate a field of regard (FOR) for the turret systems 600. The FOR can be the range of operation of a beam incorporating a Coudé path optical design. In other examples, for a passive imaging system, the turret system 600 utilizes an internal fold mirror prior to the window to provide forward line of sight (LOS) at a zero angle of depression. In some examples, the turret system 600 includes a passive optical sensor for providing imagery in one or more spectral bands in visible and infrared regions. In other examples, the turret system 600 includes a semi-active sensor for providing range finding or illuminated target tracking.

Figure 7A:
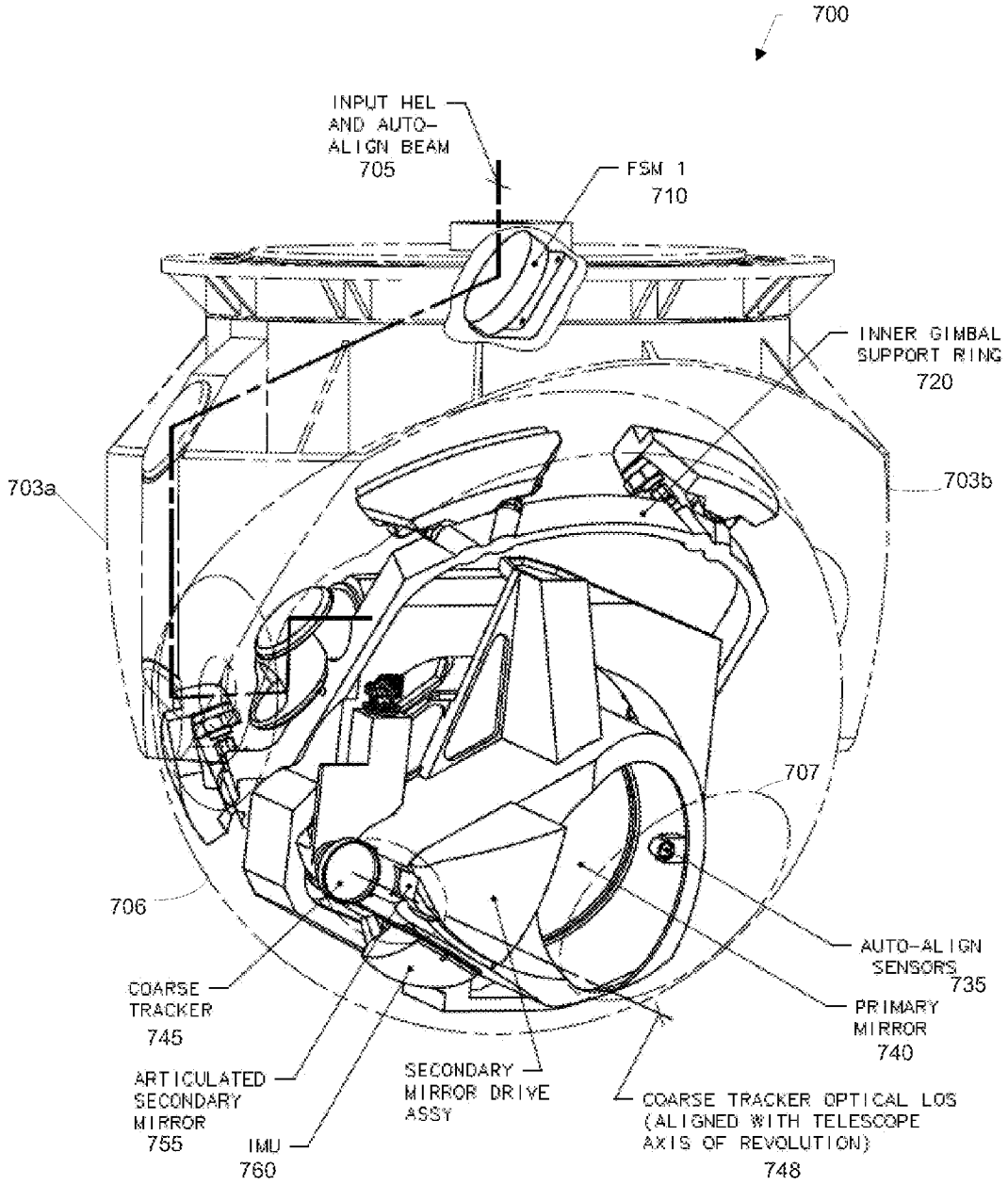
FIGS. 7A-7B are diagrams of exemplary laser beam delivery systems.
Figure 7B:
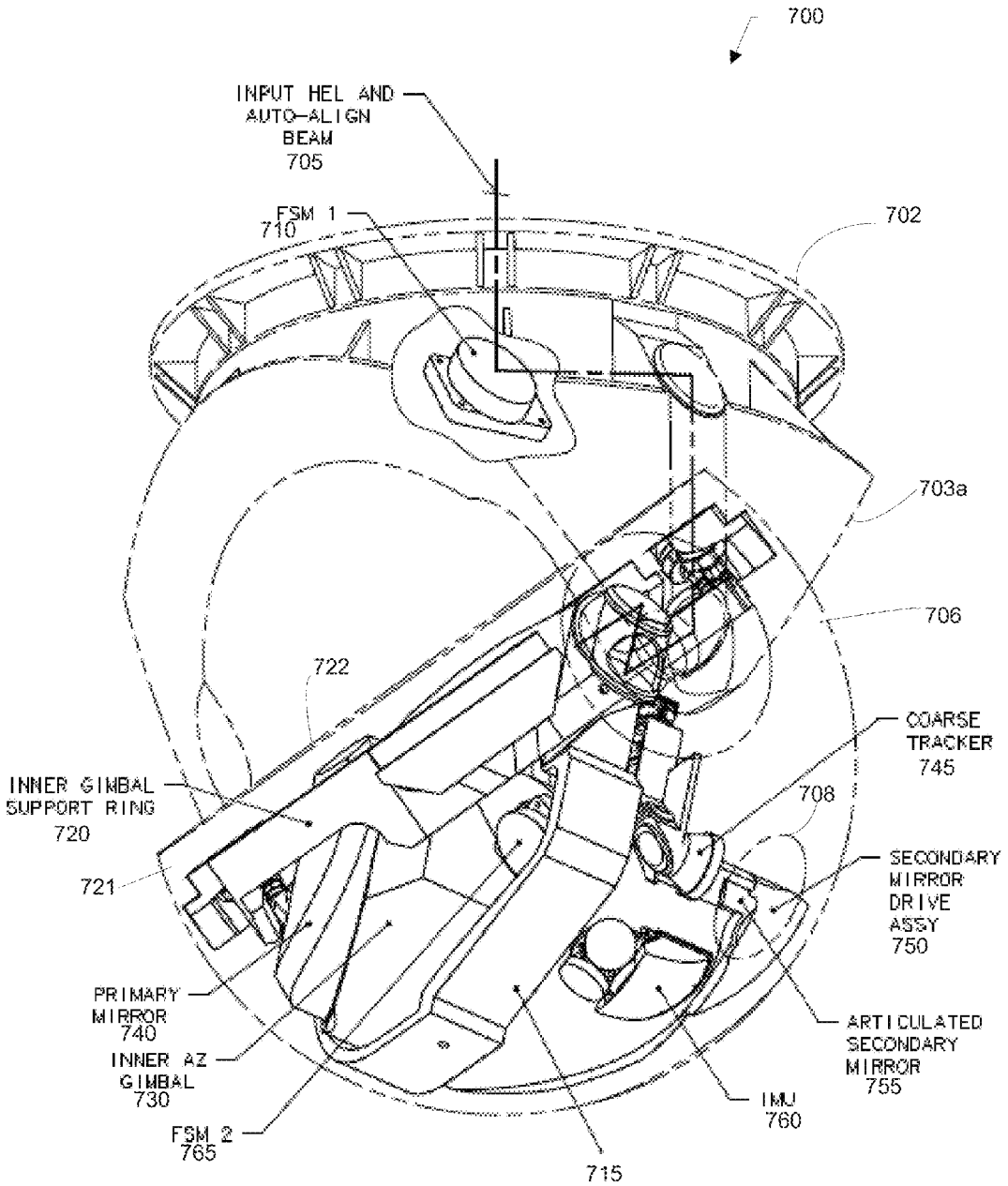

FIGS. 7A-7B are diagrams of an exemplary laser beam delivery system 700 from different views. The system 700 includes a turret platform 702, a turret payload device 706, an off-axis telescope 715, an illuminator beam device (not shown), a coarse tracker 745, an auto-alignment system 735, a wavefront error sensor (not shown), an inertial measurement unit (IMU) 760, and fast steering mirrors 710 and 765. The turret payload device 706 incorporates two conformal windows 707 and 708. The turret payload device 706 includes a payload support ring 720, two support arms 703*a* and 703*b*, and a payload windscreen shell 721 and 722. The turret platform 702, the turret support arms 703*a* and 703*b*, and the turret payload device 706 can be, for example, referred to as "the turret". The laser beam delivery system 700 with the roll-over design of the turret payload device 706 enables the technology to be continuously active since the technology has a constant base rigidity without risk of causing issues with the technology (e.g., unusual mode of operation, discharge of technology, etc.), thereby increasing the deployable environments for the technology.

The turret platform 702 provides the mechanical interface between the system 700 and the vehicle (not shown). The two support arms 703*a* and 703*b* are attached to the turret platform 702 and are rotatable along a first axis for aiming a high power laser beam and/or any other type of beam (e.g., sensor beam, infrared beam, etc.). For example, the support arms 703*a* and 703*b* are rotatable along a first axis for aiming of the turret payload device 706. The turret payload device 706 is coupled to the turret platform 702 (e.g., direct connection mechanism, isolated indirect connection mechanism to minimize vibrations, etc.). The turret payload device 706 is a truncated sphere with a spherical side and a flat side. The turret payload device 706 is configured to be rapidly deployable (e.g., within one second, within two seconds, etc.) from a vehicle (not shown) and rapidly stowable (e.g., within 1.5 seconds, within two seconds, etc.) within the vehicle.

The two conformal windows 707 and 708 are in the spherical side of the turret payload device 706. The two conformal windows 707 and 708 enable the components within the turret payload device 706 to transmit/receive beams while maintaining the aerodynamic characteristics of the turret payload device 706.

The off-axis telescope 715 is coupled to the turret payload device 706 (e.g., direct connection mechanism, isolated indirect connection mechanism to minimize vibrations, etc.). The off-axis telescope 715 has an articulated secondary mirror 755 to correct optical aberrations. The off-axis telescope 715 reflects the higher energy laser beam and/or any other type of beam to a target through the first conformal window 707.

The illuminator beam device is coupled to the turret payload device 706 in the path for the high energy laser beam 705. The illuminator beam device detects atmospheric disturbances between the system 700 and the target. The illuminator beam device detects the atmospheric disturbances by actively illuminating the target to generate a return aberrated wavefront through the first conformal window 707.

The coarse tracker 745 is coupled to the turret payload device 706. The coarse tracker 745 is positioned parallel to and on an axis of revolution of the off-axis telescope. The positioning of the Line of Sight (LOS) axis of the coarse tracker 745 on the axis of revolution of the off-axis telescope advantageously enables the coarse tracker 745 to track the same target as the off-axis telescope while minimizing the space within the turret payload device 706. The coarse tracker 745 detects, acquires, and/or tracks the target through the second conformal window 708.

The auto-alignment system 735 is coupled to the turret payload device 706. The auto-alignment system 735 includes one or more sensors for detecting alignment of the beam. The auto-alignment system 735 communicates commands to the articulated secondary mirror 755 to modify aiming of the high power laser beam and/or any other type of beam. The auto-alignment system 735 communicates commands to the fast steering mirrors 710 and 765 to modify the aiming of the high power laser beam and/or any other type of beam. The auto-alignment system 735 can advantageously communicate commands to the articulated secondary mirror 755 and/or the fast steering mirrors 710 and 765 to correct errors in the aiming of the beam, thereby increasing the efficiency of the system while reducing errors. Three angle sensors (not shown) sense an annular auto-alignment reference beam, which originates from the auto-alignment system 735. The annular auto-alignment reference beam is reflected off the fast steering mirrors 710 and 765, the secondary mirror 755, and the primary mirror 740.

The auto-alignment system 735 can close control loops that provide the mirror translation solutions to the secondary mirror 755 and the beam steering solutions to the fast steering mirrors 710 and 765. The auto-alignment system 735 can bring the off-axis telescope 715 into focus at the appropriate range along the axis of revolution and with the correct line of sight. The auto-alignment system 735 can focus the annular auto-alignment reference beam by utilizing the angle sensors. In other words, when the beam is activated, the beam propagates along the line of sight and is focused on the target at the correct range (i.e., the axis of focus of the telescope) and the coarse tracker 745 tracks the target at the correct range.

The auto-alignment system 735 and/or the coarse tracker 745 can communicate control signals to the turret payload device 706 for initial and/or final pointing and steering direction to the target. For example, the auto-alignment system 735 and/or the coarse tracker 745 can communicate control signals to a first rotating mechanism (e.g., electric motor, hydraulic arm, etc.) within the turret payload device 706 to rotate the turret payload device 706 perpendicular to a nominal direction of flight of the vehicle. As another example, the auto-alignment system 735 and/or the coarse tracker 745 can communicate control signals to a second rotating mechanism (e.g., electric motor, hydraulic arm, etc.) in one or more of the support arms 703*a* and 703*b* to rotate the turret payload device 706 perpendicular to an azimuth axis of the turret payload device 706.

The wavefront error sensor is coupled to the turret payload device 706 on the path for the high energy laser beam 705. The wavefront error sensor determines an induced distortion of the aberrated wavefront of the returning illuminator beam from the target based on a beam quality metric for the target. In some examples, the wavefront error sensor communicates commands to the articulated secondary mirror 755 based on the determined induced distortion to reduce large, low order wavefront aberrations. In other examples, the wavefront error sensor communicates commands to the articulated secondary mirror 755 based on the determined induced distortion to reduce residual tilts of the high power laser beam and/or any other type of beam. The wavefront error sensor can communicate with the articulated secondary mirror 755 and/or the fast steering mirrors 710 and 765 to remove bulk tilt and/or residual tilt, thereby advantageously reducing aiming errors associated with the beam.

The IMU 760 is coupled to the turret payload device 706. The IMU 760 detects errors from commands communicated to the turret payload device 706 based on an actual turret position. For example, the IMU 760 detects that the actual turret position is mis-aligned due to an atmospheric disturbance between the turret payload device 706 and the target. As another example, the IMU 760 detects that the actual turret position is mis-aligned due to a course change by the vehicle.

The fast steering mirrors 710 and 765 are coupled to the turret payload device 706. The fast steering mirrors 710 and 765 modify aiming of the high power laser beam and/or any other type of beam based on the detected errors. For example, the IMU 760 detects an error based on a course change by the vehicle and the fast steering mirrors 710 and 765 modify the aiming of the high power laser beam to correct the targeting based on the course change. The physical constraints of the turret payload device 706 (e.g., size, configuration, location, etc.) can cause the optical design of the off-axis telescope 715 to have a low f/number design (also referred to as a "fast" design) (e.g., a f/number less than f/1.0, a f/number less than f/2.0, etc.). The fast steering mirrors 710 and 765 and/or the secondary mirror 755 advantageously enable the system 700 to compensate for mis-alignments that can occur due to the low f/number of the design. The fast steering mirrors 710 and 765 can correct beam angle and translation. The secondary mirror 755 can correct translations in the x, y, and z axes and/or can compensate aberrations resulting from relative mirror tilts between the primary and secondary mirrors of the telescope. The fast steering mirrors 710 and 765 and the secondary mirror 755 can provide active aberration control.

The payload support ring 720 (also referred to as turret support ring) is rotary coupled (e.g., direct mechanical connection, indirect isolated connection, etc.) to the two support arms 703*a* and 703*b*. The payload support ring 720 is attached to the payload device 706 via sets of active isolator struts that de-couple the payload support ring 720 from the payload device 706, thereby eliminating the detrimental effects of wind buffeting on the payload device 706, which can adversely affect the beam's pointing accuracy. The de-coupled payload support ring 720 can serve as the prime interface for the flexure mounted two-axis stabilized structure that supports the primary mirror 740, the secondary mirror 755, the coarse tracker 745, and the IMU 760. The payload windscreen shell 721 and 722 is in a shape of a truncated sphere having a flat side 722 and a spherical side 721 on opposite sides of each other. The turret payload device 706 is rotatable along an elevation axis over a first dimension for deployment of the spherical side 721 (e.g., under an aircraft, on top of a car turret, etc.) and is rotatable over a second dimension for deployment of the flat side 722 (e.g., flush with a skin of an aircraft, flush with the top of a car turret, etc.).

The coarse tracker 745 line of sight (LOS) 748 is co-linear with the telescope's axis of revolution (the axis that passes through the apex points of the primary mirror 740 and the secondary mirror 755). In other words, the coarse tracker 745 and the off-axis telescope 715 are arranged to minimize the space for the components within the turret payload device 706 and position the axis of revolution/coarse tracker LOS 748 as low as possible in the turret payload device 706. An advantage to this horizontal configuration of the coarse tracker 745 and the off-axis telescope 715 is that the secondary window 708 is unmasked during deployment at a minimum lookdown angle, thereby enabling the coarse tracker 745 to identify the target of interest and/or to initiate an auto-alignment sequence of operation.

As illustrated in FIGS. 7A-7B, the laser beam delivery system 700 includes a plurality of mirrors for directing a high energy laser beam 705 from an optical energy system (e.g., sensor system, laser beam system, etc.) to the target. The plurality of mirrors includes a first mirror mounted within the base and for receiving optical energy from the optical energy system. The plurality of mirrors includes a second mirror mounted within a top portion of the support arm 703*a* for receiving the optical energy from the first mirror and for directing the optical energy along an axis parallel to the support arm 703*a*. The plurality of mirrors includes a third mirror mounted within a bottom portion of the support arm 703*a* for receiving the optical energy from the second mirror and for directing the optical energy through an opening in the turret payload device 706 (part or all of the turret platform). The plurality of mirrors includes a fourth mirror mounted within the in the turret payload device 706 for receiving the optical energy from the third mirror and directing the optical energy to the payload device 706 (also referred to as turret device). The secondary mirror 755 can be mounted within the payload device 706 for receiving the optical energy from the fourth mirror and for expanding the optical beam path from the fourth mirror. The primary mirror 740 mounted with the payload device 706 is for receiving the optical energy from the secondary mirror 755 and recollimating or focusing the optical energy based on a beam application.

In some examples, the laser beam delivery system 700 includes a Coudé path to provide a path for the high energy laser beam 705 from the base (the turret platform 702) via the support arm 703*a* to the target. The fast steering mirrors 710 and 765 maintain the proper beam location and orientation of the high energy laser beam through the Coudé path to the target.

In other examples, the primary mirror 740 collimates the optical energy based on a target range. For example, the beam application is a sensing application and the primary mirror 740 collimates the optical energy based on a target range. In some examples, the primary mirror 740 focuses the optical energy. For example, the beam application is a high energy weapon application and primary mirror 740 focuses the optical energy.

In some examples, the payload device 706 includes an off-axis telescope with a spherical mirror, a figure mirror, a conic mirror, an on-axis telescope with central obscuration, and/or a refractive telescope.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. A retractable rotary turret system, the system comprising:

a base comprising two support arms;

a turret platform that is a truncated sphere having a substantially flat side and a substantially spherical side, the turret platform comprising:

a turret support ring rotary coupled to the two support arms; and a turret device isolatively coupled to the turret support ring;

wherein the turret platform is rotatable along a first dimension for deployment of the spherical side and is rotatable along the first dimension for deployment of the substantially flat side, wherein the substantially flat side of the turret platform substantially conforms to a vehicle surface when the turret platform is in a stowed position.

2. The system of claim 1, wherein the turret device comprises:

a mirror drive assembly having a primary window in the spherical side of the turret platform; and a coarse tracker assembly having a secondary window in the spherical side of the turret platform.

3. The system of claim 2, wherein a center axis of the primary window is off-set and parallel to a center axis of the secondary window.

4. The system of claim 2, wherein a center axis of the mirror drive assembly is off-set and parallel to a center axis of the turret platform.

5. The system of claim 2, wherein the primary window and the secondary window are curved to conform to an outer surface of the spherical side.

6. The system of claim 2, wherein the primary window and the secondary window are substantially flat.

7. The system of claim 1, further comprising:

a first mirror mounted within the base and for receiving optical energy from an optical energy system;

a second mirror mounted within a top portion of the first support arm for receiving the optical energy from the first mirror and for directing the optical energy along an axis parallel to the first support arm;

a third mirror mounted within a bottom portion of the first support arm for receiving the optical energy from the second mirror and for directing the optical energy through an opening in the turret platform;

a fourth mirror mounted within the turret platform for receiving the optical energy from the third mirror and directing the optical energy to the turret device;

a secondary mirror mounted within the turret device for receiving the optical energy from the fourth mirror and for expanding the optical beam path from the fourth mirror; and a primary mirror mounted with the turret device for receiving the optical energy from the secondary mirror and recollimating or focusing the optical energy based on a beam application.

8. The system of claim 7, wherein the beam application is a sensing application and the telescope collimates the optical energy based on a target range.

9. The system of claim 7, wherein the beam application is a high energy weapon application and the primary mirror focuses the optical energy onto a target.

10. The system of claim 1, wherein the turret device comprises a high energy laser pointing and tracking system, wherein the high energy laser pointing and tracking system is usable during deployment of the spherical side of the turret platform.

11. The system of claim 1, wherein the turret device comprises a passive optical sensor for providing imagery in one or more spectral bands in visible and infrared regions.

12. The system of claim 1, wherein the turret device comprises a semi-active sensor for providing range finding or illuminated target tracking.

13. The system of claim 1, wherein the turret platform is rotatable along two axes, the first axis for deployment and aiming of the turret device, and the second axis for aiming of the turret device.

14. The system of claim 1, wherein the turret platform geometry is defined as $a^2=b(2R-b)$, wherein:

a is ½ of a maximum span of a circular footprint of the stowed side of the turret platform flush with an external surface of a vehicle;

b is a maximum height of the spherical side when deployed from the vehicle; and

R is a radius of the turret platform.

15. A truncated sphere turret platform, the turret platform comprising:

a turret support ring rotary rotatable along an elevation axis; and a turret device isolatively coupled to the turret support ring;

wherein the turret platform having a flat side and a spherical side, and wherein the turret platform is rotatable along the elevation axis for deployment of the spherical side and is rotatable along the elevation axis for deployment of the flat side, wherein the substantially flat side of the turret platform substantially conforms to a vehicle surface when the turret platform is in a stowed position.

16. The turret platform of claim 15, wherein the turret device comprises an off-axis telescope with a spherical mirror, a figure mirror, a conic mirror, an on-axis telescope with central obscuration, a refractive telescope, or any combination thereof.

17. The turret platform of claim 15, wherein the turret platform comprising a plurality of apertures in the deployed side of the turret platform.

18. The turret platform of claim 15, wherein the turret device comprising:

a mirror drive assembly having a primary window in the spherical side of the turret platform; and a coarse tracker assembly having a secondary window in the spherical side of the turret platform, wherein the primary window and the secondary window are mounted side-by-side in the spherical side of the turret platform.

19. A turret payload system, the system comprising:

a payload support ring rotary coupled to two support arms; and a payload device isolatively coupled to the payload support ring; and a payload windscreen shell in a shape of a truncated sphere having a substantially flat side and a substantially spherical side on opposite sides of each other;

wherein the turret payload system is rotatable along the elevation axis over a first dimension for deployment of the spherical side and is rotatable over a second dimension for deployment of the flat side, wherein the substantially flat side of the payload windscreen shell substantially conforms to a vehicle surface when stowed.

20. The turret payload system of claim 19, wherein the substantially spherical side of the payload windscreen shell provides a minimum protrusion outside a vehicle and maintains a maximum field of regard when deployed.

* * * * *